United States Patent [19]

Küffner et al.

[11] 4,436,810

[45] Mar. 13, 1984

[54] COLOR-PHOTOGRAPHIC RECORDING MATERIAL CONTAINING NON-DIFFUSING ELECTRON DONOR PRECURSOR COMPOUNDS

[75] Inventors: Karl Küffner, Unterhaching; Paul Marx, Leverkusen; Wolfgang Lässig, Munich, all of Fed. Rep. of Germany

[73] Assignee: Agfa-Gevaert Aktiengesellschaft, Leverkusen, Fed. Rep. of Germany

[21] Appl. No.: 490,128

[22] Filed: Apr. 29, 1983

[30] Foreign Application Priority Data

May 12, 1982 [DE] Fed. Rep. of Germany ..... 3217877

[51] Int. Cl.[3] ..... G03C 1/10; G03C 1/40; G03C 5/24; G03C 7/26

[52] U.S. Cl. ..... 430/551; 430/214; 430/218; 430/440; 430/443; 430/483; 430/542; 430/559; 430/566; 430/959

[58] Field of Search ..... 430/214, 218, 223, 440, 430/443, 483, 551, 566, 543, 542, 559, 959

[56] References Cited

U.S. PATENT DOCUMENTS 4,232,107 11/1980 Janssens ..... 430/218

4,263,393 4/1981 Chen ..... 430/218

*Primary Examiner*—Richard L. Schilling

*Attorney, Agent, or Firm*—Connolly and Hutz

[57] ABSTRACT

Compounds corresponding to the formula:

I wherein

Z represents a radical which completes a condensed aromatic ring system;

$R^1$ represents an n-valent aliphatic or aromatic radical;

$R^2$ represents H, alkyl or aryl, $R^3$ represents one or more radicals to control the diffusion properties and the activation pH;

and n represents 1 or 2, are suitable ED precursor compounds for use in color-photographic recording materials. They are preferably used in a combination with reducible dye-releasers. They are also suitable as so-called scavengers.

3 Claims, 2 Drawing Figures

Figure 1:
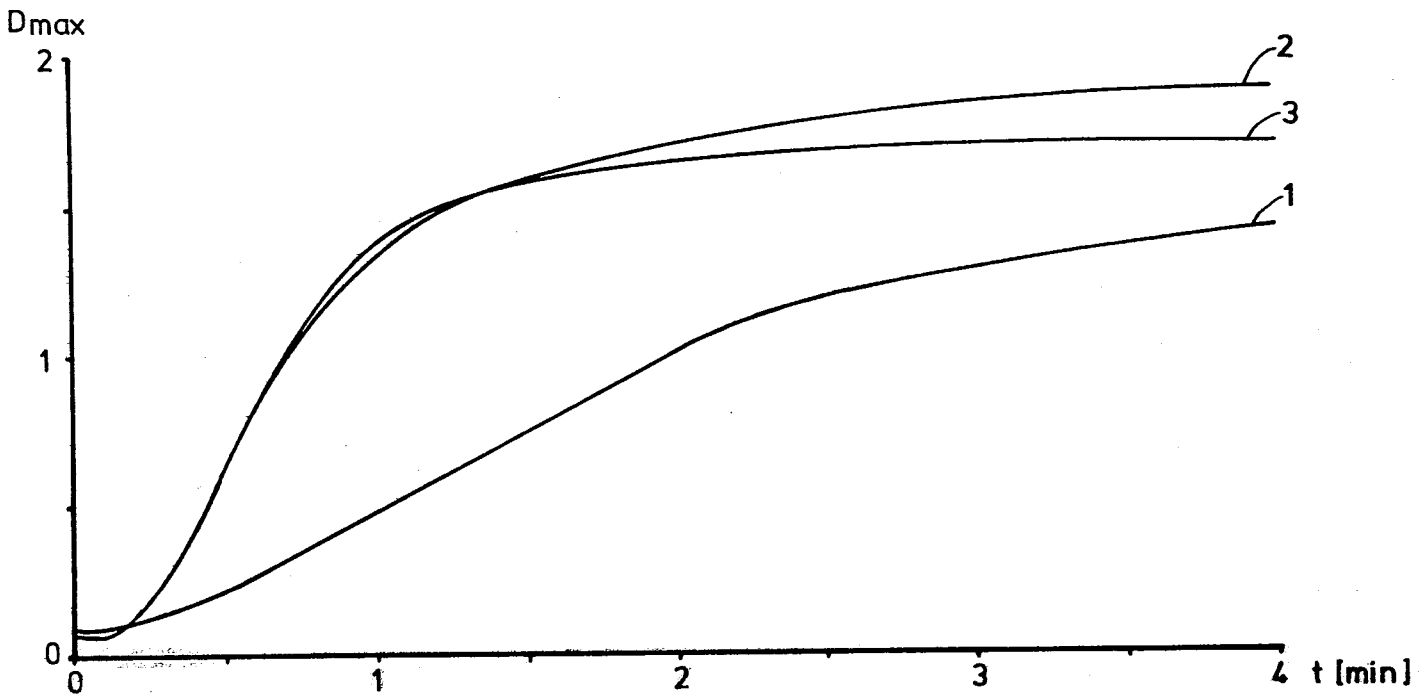

COLOR-PHOTOGRAPHIC RECORDING MATERIAL CONTAINING NON-DIFFUSING ELECTRON DONOR PRECURSOR COMPOUNDS

This invention relates to a color-photographic recording material comprising at least one photo-sensitive silver halide emulsion layer which contains non-diffusing electron donor precursor compounds, from which strong reducing agents are formed under alkaline development conditions. The invention relates in particular to a recording material, in which the electron donor precursor compounds mentioned are used in combination with non-diffusing reducible color-providing compounds which, in reduced condition, release diffusible dyes under alkaline development conditions, which dyes are used as such for the formation of the image or are first of all converted into the metal complexes thereof.

DE-A No. 2,809,716 describes color-providing compounds containing an electron-accepting nucleophilic precursor group, which compounds, in reduced condition, are subject to an intramolecular nucleophilic displacement reaction under alkaline development conditions, with the release of a diffusible dye.

The reduction is caused by so-called electron donor compounds (ED compounds) which are contained in the layers in addition to the color-providing compounds and are oxidized image-wise during development and are thus consumed.

The remaining image-wise distribution (positive residual image) of the ED compounds reacts with the color providing compound and initiates the image-wise release of diffusible dyes. The ED compounds which are described in that publication are, for example, derivatives of benzisoxazolone, hydroquinone, p-aminophenol and ascorbic acid. Inorder to allow the production of qualitatively high-grade images according to the process described in the above-mentioned publication, the ED compounds must not only be oxidized by exposed silver halide or by silver halide developer oxidation products, but they must also themselves be capable of reducing the color-providing compounds. Moreover, the respective rates of the oxidation or reduction reaction must be optimally coordinated with each other so that the ED compound is already oxidized to an appreciable extent in the course of development, before it is capable for its part of reducing the color-providing compound. The known ED compounds do not satisfy these requirements in every respect, which is shown, for example, in an inadequate color density and/or in an unacceptable color fog of the color transfer images which have been produced.

The high reducing power of suitable ED compounds simultaneously stipulates a high sensitivity to oxidation, which is expressed, during a comparatively long storage of the photographic recording material, in a premature, nonimagewise consumption of the ED compounds by oxidation and in image properties of the transfer image which are impaired thereby and which exist in particular in an inadequate color density. It is also already known from DE-A No. 2,809,716 that ED compounds may not be used as such, but in the form of a less oxidation-sensitive precursor compound from which the actual ED compound is formed only under alkaline development conditions. Examples of these compounds include the ED compounds ED-8, ED-9 and ED-10 of the publication mentioned. However, only an inadequate density of the color transfer image is obtained with the known ED precursor compounds within an acceptable development time, which may be caused either by the actual ED compound not being produced rapidly enough from the corresponding precursor compound or by the ED compound having too low a reducing power. ED precursor compounds which are described in U.S. Pat. No. 4,263,373 are derived from α-aminoketones and their amino-N atom is included as a ring member in a certain heterocyclic ring.

An object of the present invention is to provide new oxidation-stable ED precursor compounds which have a good storage stability in the photographic material at elevated temperature and/or elevated moisture and from which ED compounds having a high reducing power are formed relatively quickly only under alkaline development conditions. In particular, these compounds are to allow the production of color transfer images of an improved color density in the dye diffusion transfer process when used in combination with non-diffusing, reducible, color providing compounds.

This invention provides a color-photographic recording material comprising at least one photosensitive silver halide emulsion layer and a non-diffusing color providing compound associated with this layer, which recording material contains, in at least one photosensitive silver halide emulsion layer or in a non-photosensitive binder layer, a non-diffusing electron donor precursor compound (ED precursor compound), from which a non-diffusing ED compound is formed under alkaline development conditions, characterised in that the ED precursor compound corresponds to the following formula I:

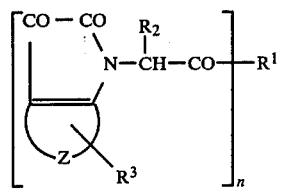

I wherein:

Z represents a radical which completes a condensed aromatic ring system;

$R^1$ represents an n-valent aliphatic or aromatic radical;

$R^2$ represents H, alkyl or aryl;

$R^3$ represents one or more radicals to control the diffusion properties and the activation pH; and n represents 1 or 2.

The ED precursor compounds according to the present invention, which are derivatives of isatin, are widely suitable for use in color-photographic recording materials where strong reducing agents are to be introduced into the layers in masked form, whether as a masked developing agent for silver halide or as a masked reducing agent to prevent the undesired diffusion of oxidation products which are produced from the silver halide development. It is of no importance which type of color-providing compound is used to produce the color images. They may be color couplers or color-providing compounds which release diffusible dyes as a result of development (dye-releasers). However, the preferred use of the ED precursor compounds according to the present invention is seen in a combination with non-diffusing, reducible color-providing compounds which, in a reduced form, release diffusible dyes under alkaline development conditions.

Thus, the present invention preferably provides a color-photographic recording material comprising at least one photosensitive silver halide emulsion layer and a combination associated therewith of a non-diffusing, reducible color-providing compound which, in its reduced form, is capable of releasing a diffusible dye under alkaline development conditions, and a non-diffusing electron donor precursor compound (ED precursor compound), from which a non-diffusing electron donor compound (ED compound) is formed under alkaline development conditions, the ED compound being capable of reducing the non-diffusing, color providing compound under alkaline development conditions, characterised in that the recording material contains a compound corresponding to the general formula I as the ED precursor compound.

The condensed aromatic ring system, which is completed by Z in formula I, is preferably a condensed benzene ring.

The aromatic radical represented in formula I by $R^1$ may be a carbocyclic group, for example (when n=1) a phenyl, naphthyl or an anthracenyl group or a 5- or 6-membered heterocyclic group having at least one of the hetero atoms N, O, or S as a ring member, for example a furyl, thienyl, pyrryl or pyridyl group. When n=2, the corresponding 2-valent groups are included. The carbocyclic and heterocyclic aromatic groups may be unsubstituted or mono- or poly-substituted, and may contain carbocyclic or heterocyclic rings condensed thereon which do not need to be aromatic in this case.

An aryl group represented in formula I by $R^2$ is in particular a phenyl group which may also be mono- or poly-substituted.

The following are included, for example, as substituents on the radical represented by $R^1$ and $R^2$, and as $R^3$: fluorine, chlorine, bromine or iodine, hydroxy, sulfo, sulfamoyl, trifluoromethyl, trifluoromethylsulfonyl, amino, nitro. cyano, carboxy, carbamoyl, alkoxycarbonyl, alkyl, alkenyl, cycloalkyl, in particular cyclohexyl or cyclopentyl, aryl, in particular phenyl, or heterocyclic groups, and the last-mentioned groups (alkyl, alkenyl, cycloalkyl, aryl and heterocyclic groups) may contain other substituents, for example, those of the previously mentioned type, and the alkyl, alkenyl, cycloalkyl, aryl or heterocyclic groups mentioned are either joined directly or by one of the following divalent connecting links: —O—, —S—, —$SO_2$—, —$SO_2$—NR—, —NR—$SO_2$—, —CO—, —NR—CO—, —CO—NR—, —NR—COO—, —O—CO—NR—, —NR—CO—NR— (R=hydrogen or alkyl).

As shown by variations of substituents, the so-called activation pH, i.e., the pH at which the CO-N bond of the isatin ring is split up hydrolytically and thus the active ED compound is released, may be controlled by the choice of the substituents $R^3$. On the other hand, the type of substitution at the aromatic radicals represented by $R^1$ and $R^2$ mainly influences the redox potential of the ED compounds of the present invention.

The alkyl groups optionally represented by $R^2$ and the alkyl or alkenyl groups which are optionally present as a substituent on $R^1$ and $R^2$ may be straight or branched and may contain from 1 to 22 carbon atoms, and may optionally also be further substituted, for example by halogen (such as fluorine, chlorine or bromine), hydroxy, amino, alkoxy, aroxy, alkylthio, arylthio, a heterocyclic thioether group, alkylsulfonyl, arylsulfonyl or a heterocyclic group, such as a 5- or 6-membered heterocyclic ring which is joined via a ring nitrogen atom.

In preferred embodiments of the present invention, $R^1$ represents an optionally substituted phenyl group and $R^2$ in preferred embodiments represents hydrogen.

According to the present invention, all of the substituents present in the ED precursor compound are constituted such that the ED precursor compound can be embedded in a non-diffusing manner in photographic layers. For this purpose, for example at least one of the substituents present, for example at least one of the radicals $R^1$ and $R^3$, contains a ballast radical. A diffusion-resistant embedding of the ED precursor compound is thus particularly desirable, because these compounds are used in an exact localisation in a specific layer or in a specific quantity in relation to associated, non-diffusing, reducible color-providing compounds which should, as far as possible, not undergo any substantial changes even during a comparatively long storage of the photographic recording material.

Ballast radicals are considered to be those which allow the compounds according to the present invention to be embedded in a diffusion-resistant manner in the hydrophilic colloids which are usually used in photographic materials. Organic radicals which are preferably suitable for this purpose generally contain straight- or branched-chain aliphatic groups generally having from 8 to 22 carbon atoms, and optionally also carbocyclic or heterocyclic aromatic groups. These radicals are joined to the remaining part of the molecule either directly or indirectly, for example by one of the following groups: —NHCO—, —$NHSO_2$—, —NR—, wherein R represents hydrogen or alkyl, —O— or —S—. The ballast radical may also contain water-solubilizing groups, for example sulfo groups or carboxyl groups, which may also be present in certain cases in anionic form. Since the diffusion properties depend on the molecular size of the complete compound used, it suffices in certain cases, for example if the complete molecule which is used is large enough, or if the ED precursor compounds are worked into the layers in emulsified form using so-called oil formers or high-boiling coupler solvents, to use comparatively short chain radicals, for example, isoamyl- or tert.-butyl radicals as ballast radicals.

For use in dye diffusion processes for the production of colored transfer images, the radicals represented by $R^3$ and optionally also $R^1$ are appropriately to be provided with ballast groups, so that the partly colored cleavage products which are produced by alkaline hydrolysis after oxidation of the ED compounds also remain in the photographic layer in a diffusion-resistant manner. On the other hand, it is advantageous for uses of the ED compounds of the present invention for the production of so-called retained images to provide only the radical $R^1$ specifically with ballast groups. According to experience, such isatin derivatives of the present invention split up after oxidation into non-diffusion, substantially colorless ketoaldehydes and into neutral, but deep yellow isatins which are diffusible in an alkaline medium.

An essential advantage of such ED precursor compounds according to the present invention is thus also the fact that they do not leave any constituents behind after development of the photographic material which would impair the image whites of the retained image.

A few examples of the non-diffusing ED precursor compounds which are used according to the present invention are provided in the following:

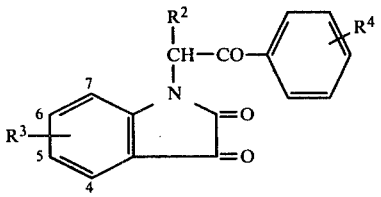

| Compound No. | $R^2$ | $R^3$ | $R^4$ |
|---|---|---|---|
| 1 | H | H | H |
| 2 | H | H | P—$OCH_3$ |
| 3 | H | H | P—$NO_2$ |
| 4 | —$CH_3$ | H | H |
| 5 | H | 5-Br | H |
| 6 | H | 5-$NO_2$ | H |
| 7 | H | 7-$CH_3$ | H |
| 8 | H | H | p-O—$C_{14}H_{29}$ |
| 9 | H | H | o-O—$C_{14}H_{29}$ |
| 10 | H | H | o-O—$C_8H_{17}$ |
| 11 | H | H | o-O—$C_{10}H_{21}$ |
| 12 | H | H | m-NH—CO—$C_{15}H_{31}$ |
| 13 | H | H | p-NH—CO—$C_{15}H_{31}$ |
| 14 | H | 5-Br | p-O—$C_{14}H_{29}$ |
| 15 | H | 5-Br,7-Br | p-O—$C_{14}H_{29}$ |
| 16 | H | 4-$CH_3$,6-$CH_3$ | p-O—$C_{14}H_{29}$ |
| 17 | H | 4-$CH_3$,5-Cl, 7-$OCH_3$ | p-O—$C_{14}H_{29}$ |
| 18 | H | 5-Br,7-Br | o-O—$C_{14}H_{29}$ |
| 19 | H | H | o-O—$C_{12}H_{25}$ |
| 20 | H | 5-Br,7-Br | o-O—$C_{12}H_{25}$ |
| 21 | —$CH_3$ | H | p-O—$C_{14}H_{29}$ |
| 22 | —$CH_3$ | 5-Br,7-Br | p-O—$C_{14}H_{29}$ |
| 23 | H | 5-NH—CO—$C_{15}H_{31}$ | H |
| 24 | H | 5-$SO_2N(C_{18}C_{37})$—$C_6H_5$ | H |
| 25 | H | 5-Cl,7-Cl | p-O—$C_{14}H_{29}$ |
| 26 | H | H | p-S—$C_{12}H_{25}$ |

Compound No. 27

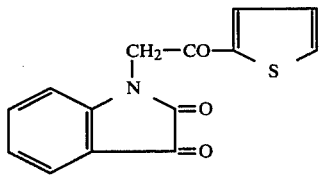

The production of some of the ED-precursor compounds which are used according to the present invention will now be described in the following.

Compound No. 8

3.7 g of 4-tetradecyloxy-ω-bromo-acetophenone (9 mmol)
were suspended in
40 ml of dimethylformamide (DMF)
and stirred with
1.6 g of isatin (11 mmol)
and
0.54 g of sodium carbonate (5 mmol)
at room temperature. After 3½ hours, the deposit was suction-filtered and washed first of all with methanol, then with water and then with methanol.

Yield: 1.9 g (=44% of the theoretical yield);
m.p. 130°–132° C.

Compound No. 14

3.9 g of 4-tetradecyloxy-ω-bromo-acetophenone (9.5 mmol)
were suspended in
35 ml of DMF
and stirred with
2.26 g of 5-bromo-isatin (10 mmol)
and
0.54 g of sodium carbonate (5 mmol)
at room temperature. The deposit was suction-filtered after 15 hours and washed first of all with methanol, then with water and lastly with methanol. The crude product 3.4 g was stirred with hot propanol and suction-filtered again.

Yield: 2.5 g (=47% of the theoretical yield);
m.p. 141°–142° C.

Compound No. 15

This compound was synthetized analogously to compound No. 14, but instead of 5-bromo-isatin,
3.05 g of 5,7-dibromo-isatin (10 mmol)
were used.

Yield: 3.2 g (=56% of the theoretical yield);
m.p. 77°–80° C.

Compound No. 16

This compound was synthetized analogously to compound No. 14, but instead of 5-bromo-isatin,
1.75 g of 4,6-dimethylisatin (10 mmol)
were used.

Yield: 3.8 g (=84% of the theoretical yield);
m.p. 151°–153° C.

Compound No. 17

This compound was synthetized analogously to compound No. 14, but instead of 5-bromo-isatin,
2.25 g of 5-chloro-7-methoxy-4-methylisatin (10 mmol)
were used.

Yield: 1.7 g (=30% of the theoretical yield);
m.p. 108°–112° C.

Compound No. 21

1.9 g of 4-tetradecyloxy-α-bromo-propiophenone (4.5 mmol)
were stirred with
0.7 g of isatin (5 mmol),
0.27 g of sodium carbonate (2.5 mmol) in
20 ml of DMF
for 10 hours at room temperature, then suction-filtered and thereafter washed with methanol, water and methanol.

Yield: 1 g (=87% of the theoretical yield);
m.p. 125°–127° C.

Compound No. 13

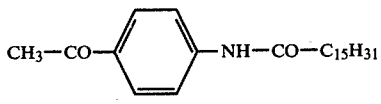

(a)

20.25 g of p-aminoacetophenone
were dissolved in 100 ml of pyridine and mixed dropwise with stirring with 41.4 g of palmitic acid chloride at 15° to 20° C. The mixture was further stirred for another hour and then poured onto ice/hydrochloric acid. After suction-filtering, the mixture was washed with water until neutral and recrystallized from methanol while still moist.

Yield: 49 g;
m.p. 112°–114° C.

(b)

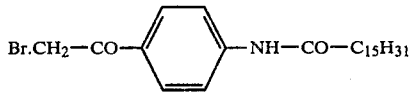

4.78 g of acetophenone
from stage a were mixed with 2 g of bromine in 80 ml of glacial acetic acid at from 40° to 50° C.

After decolorisation and cooling to room temperature, the precipitated product was suction-filtered and recrystallised from ethanol.

Yield: 4.1 g;
m.p. 119°–121° C.

c. Compound No. 13

2.04 g of bromo-acetophenone from experiment b. (4.5 mmol),
0.8 g of isatin (5.4 mmol), and
0.27 g of sodium carbonate (2.5 mmol)
were stirred into
20 ml of DMF
for 3 hours at room temperature.

The mixture was poured into ice water, adjusted to be slightly alkaline using sodium carbonate and suction-filtered. It was then washed successively with ethanol, water and ethanol and recrystallised from ethanol/propanol.

Yield: 1 g (=43% of the theoretical yield);
m.p. 157°–161° C.

The ED precursor compounds according to the present invention are superior to the known ED compounds, for example ascorbyl palmitate, and also to the known ED precursor compounds insofar as higher maximum color densities may be produced simultaneously with lower minimum color densities (fog) with these compounds within a given development time. It remains to be seen whether the higher maximum color densities which are obtained are to be attributed to a ready cleavage (hydrolysis) of the heterocyclic ring and thus to a more rapid availability of the actual ED compounds, or to the higher reducing power thereof, or to both influences.

Another advantage of the ED precursor compounds according to the present invention is that they are in an oxidation-insensitive form and are only converted into the actual ED compounds during development by treatment with aqueous alkali (hydrolytic cleavage of the ring).

The reducible dye-releasers which are used in combination with the ED precursor compounds according to the present invention release a diffusible dye under alkaline development conditions by reduction or as a result of reduction. Reducible dye-releasers are described in the following publications: DE-A No. 2,809,716; DE-A No. 3,008,588; DE-A No. 3,014,669; in EP-A No. 0,004,399 and in GB-A No. 8,012,242. Reducible dye-releasers which are more preferably used according to the present invention correspond to the following formula II:

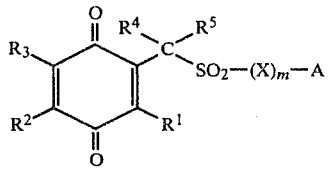

II wherein $R^1$ represents alkyl or aryl;

$R^2$ represents alkyl, aryl or a group which, together with $R^3$, completes a condensed ring;

$R^3$ represents hydrogen, alkyl, aryl, hydroxyl, halogen such as chlorine or bromine, amino, alkylamino, dialkylamino including cyclic amino groups (such as piperidino or morpholino), acylamino, alkylthio, alkoxy, aroxy, sulfo or a group which, together with $R^2$, completes a condensed ring;

$R^4$ represents alkyl;

$R^5$ represents alkyl or preferably hydrogen;

A represents the radical of a diffusible dye or dye precursor;

X represents a bivalent connecting member of the formula $—R—(L)_p—(R)_q—$, wherein R represents an alkylene radical having from 1 to 6 carbon atoms or an optionally substituted arylene or aralkylene radical, and the two radicals R may have the same or different meanings;

L represents —O—, —CO—, —$CONR^6$—, —$SO_2NR^6$—, —O—CO—$NR^6$—, —S—, —SO— or —$SO_2$— ($R^6$=hydrogen or alkyl);

p represents 0 or 1;

q represents 0 or 1; and m represents 0 or 1, and at least one of the radicals $R^1$, $R^2$, $R^3$ and $R^4$ contains a ballast radical.

The alkyl radicals represented in formula II by $R^1$, $R^2$, $R^3$ and $R^5$ may be straight or branched-chain and usually contain up to 18 carbon atoms. Examples thereof include methyl, n-propyl, tert.-butyl, tetradecyl and octadecyl. The aryl radicals represented by the radicals $R^1$, $R^2$ and $R^3$ mentioned are, for example, phenyl groups which may be substituted, for example by long-chain alkoxy groups.

In an acylamino radical represented by $R^3$, the acyl group is derived from aliphatic or aromatic carboxylic acids or sulfonic acids. The condensed rings which are completed by $R^2$ and $R^3$ are preferably carbocyclic rings, for example condensed benzene- or bicyclo-[2,2,1]-heptene rings.

An alkyl radical represented by $R^4$ may be straight- or branched-chain, substituted or unsubstituted and may contain up to 21 carbon atoms. Examples include methyl, nitromethyl, phenylmethyl (benzyl), heptyl, tridecyl; pentadecyl, heptadecyl and —$C_{21}H_{43}$.

Preferred embodiments of the dye-releasers which are used according to the present invention are those in which $R^1$, $R^2$ and $R^3$ in a quinoid carrier radical together contain not more than 8, in particular not more than 5 carbon atoms, and $R^4$ represents an alkyl radical having at least 11 carbon atoms.

Preferred embodiments are also those in which $R^1$ represents an alkoxyphenyl radical having at least 12 carbon atoms in the alkoxy group and $R^2$, $R^3$ and $R^4$ together do not contain more than 8 carbon atoms.

The reducible dye-releasers which are preferably used contain, per dye radical, one releasable quinoid carrier radical which confers diffusion resistance and corresponds to the formula:

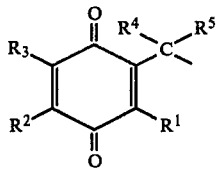

"Carquin"

wherein $R^1$, $R^2$, $R^3$, $R^4$ and $R^5$ are as defined above.

In principle, the radicals of dyes of all dye classes are suitable as dye radicals if they are diffusible enough to be able to diffuse through the layers of the photosensitive material into the image-receiving layer. For this purpose, the dye radicals may be provided with one or more alkali-solubilizing groups. The following, inter alia, are suitable as alkali-solubilizing groups: carboxyl groups, sulfo groups, sulfon-amide groups and aromatic hydroxyl groups. Such alkali-solubilizing groups may already be preformed in the dye-releasers used according to this invention, or may only be produced from the splitting-off action of the dye radical from the carrier radical loaded with ballast groups. The following are mentioned as dyes which are particularly suitable for the present process: azo dyes, azomethine dyes, anthraquinone dyes, phthalocyanine dyes, indigoid dyes, triphenylmethane dyes, including those dyes which are complexed or may be complexed with metal ions.

The term "radicals of dye precursors" is understood to mean the radicals of such compounds which are converted into dyes during photographic processing by conventional or additional processing steps, whether by oxidation or by coupling, by complex formation or by exposing an auxochromic group in a chromophoric system, for example by saponification. Dye precursors in this context may be leuko dyes, couplers or dyes which are converted into other dyes during processing. As far as a differentiation between dye radicals and the radicals of dye precursors is not of paramount importance, the latter should also be understood hereinafter under the term "dye radicals".

In a preferred embodiment of the present invention, the color-photographic recording material in monochomatic processes contains at least one image-producing layer unit, and in processes for the production of multicolored images, the colour-photographic recording material usually contains at least three image-producing layer units, each of which contains at least one photosensitive silver halide emulsion layer and a combination associated with this layer of a non-diffusing, reducible color-providing compound and an electron donor compound, one ED precursor compound according to the present invention being used in at least one layer unit. One of the layer units is usually predominantly sensitive to blue light, another layer unit is predominantly sensitive to green light and a third unit predominantly sensitive to red light, the associated color-providing compounds in each case providing complementary-colored image dyes.

The terms "association" and "associated" are understood to mean that the mutual arrangement of silver halide emulsions, ED compound or ED precursor compound and dye-releaser is such that an interaction is possible between them which allows an image-wise conformity between the silver image which has formed and the consumption of ED compound on the one hand and between the unconsumed ED compound and the dye-releaser on the other hand, so that in conformity with the undeveloped silver halide, an image-wise distribution of diffusible dye is produced. For this purpose, the photosensitive silver halide and the combination of dye-releaser and ED compound do not necessarily have to be in the same layer. They may also be accommodated in adjacent layers which in each case belong to the same layer unit.

In order to ensure an adequate interaction between the dye-releaser and the associated ED precursor compound, it is advisable to accommodate both these compounds of one combination in the same layer which, however, does not have to be identical to the associated silver halide emulsion layer. The fact that the ED precursor compounds according to the present invention are stable to hydrolysis under neutral conditions, and thus are also oxidation-insensitive, means that these compounds are particularly suitable for use in a common emulsion (together with the dye-releaser), while conventional ED compounds have too high an oxidation sensitivity under comparable conditions, so that they cannot be used in the same emulsion with the dye-releasers.

All methods by which hydrophobic compounds are usually worked into photographic layers are suitable for working in the ED precursor compounds of the present invention, i.e., the conventional emulsifying techniques are included, for example methods by which photographic auxiliaries are added to the casting solutions in the form of emulsifiers using so-called oil formers. During this process, all methods which necessitate the use of alkali should appropriately be avoided.

The reducible dye-releaser is usually used in a layer in a sufficient quantity for producing a color image having as high a maximum color density as possible, for example in a quantity of from 1 to $20\times10^{-4}$ mol/m$^2$. The quantity of ED precursor compound according to this invention is adapted to the quantity of dye-releaser. It should be sufficient in order to achieve as high a maximum color density as possible, i.e., to be able to cause as complete a reduction of the dye-releaser as possible. On the other hand, it should not be substantially higher than required for this purpose, so that the reducing agent produced therefrom may be consumed as completely as possible by the development of the exposed silver halide in the exposed areas. The quantity ratios which are most favourable in each individual case between silver halide, ED precursor compound and dye-releaser are appropriately determined by routine experiments. Reliable results may be obtained, for example, when the ED precursor compound is present in each case in from 0.5 to 5 times the molar quantity, based on the dye-releaser. The suitable quantity ratio between silver halide and the associated dye-releaser approximately ranges from 2 to 20 mols of silver halide per mol of dye-releaser.

Intermediate layers are appropriately present between different layer units and they may contain compounds which are capable of reacting with diffusing development products and are capable of stopping the diffusion thereof from one layer unit into another. This contributes to the fact that the association remains restricted in each case to one layer unit. Compounds of this type are known. For example, non-diffusing hydroquinone derivatives and, for example, the "scavenger compounds" described in the publication "Research Disclosure No. 17,842" (February 1971) are suitable for this purpose. Last but not least, the ED precursor compounds according to this invention may also take over this function, that is, independently of the type of color-providing compound which is used (color coupler, dye-releaser), if the ED precursor compounds of the present invention are embedded as so-called scavengers in an intermediate layer between different layer units.

The interaction between the exposed silver halide and the ED compound is generally caused by the oxidized form of the silver halide developing agent which is used. The latter is oxidized image-wise during development and the oxidation product is, for its part, capable of oxidizing the ED compound and thus of withdrawing from the reaction with the dye-releaser.

The following, for example, are included as silver halide developing agents: hydroquinone and derivatives thereof, catechol and derivatives thereof, p-phenylenediamine derivatives and 3-pyrazolidone compounds, in particular 1-phenyl-3-pyrazolidone, 1-phenyl-4,4-dimethyl-3-pyrazolidone, 4-hydroxymethyl-4-methyl-1-phenyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(4-tolyl)-4-hydroxymethyl-4-methyl-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone and 5-methyl-3-pyrazolidone, including those derivatives of 3-pyrazolidone which are present in masked form, for example acetylated phenidone derivatives.

A combination of different silver halide developing agents may also be used. The silver halide developing agents may be contained in an alkaline developer preparation or may be completely or partly contained in one or more layers of the color-photographic recording material to be processed.

In order to carry out the dye diffusion transfer process according to the present invention, a photosensitive element is usually used which contains one or more silver halide emulsion layer units and the reducible dye-releasers associated therewith and ED compounds or precursors thereof, and an image-receiving element is usually used, in which the required color image is produced by the image-wise transfer of the released dyes. For this purpose, there must be a firm contact between the photosensitive element and the image-receiving element at least during a finite period of time within the developing time, so that the image-wise distribution of diffusing dyes which is produced in the photosensitive element as a result of development may be transferred onto the image-receiving element. The content may be produced after development has been started, or it may already have been produced before development starts. The latter is the case, for example, if a so-called integral recording material is used for carrying out the dye diffusion transfer process, in which material the photosensitive element and the image-receiving element form an integral unit, also termed hereinafter a "monosheet material", which may still exist at the end of the development procedure, even if the photosensitive element is not separated from the image-receiving element even after the color transfer has been completed. An embodiment of this type is described, for example, in DE-A No. 2,019,430.

Accordingly, the image-receiving element may be a component of the color-photographic recording material, for example in the form of an image-receiving layer which is positioned on a transparent substrate below the photosensitive element, a light-impermeable, preferably a light-reflecting, binder layer appropriately being located between the image-receiving layer and the photosensitive element. The image-receiving layer which, in another form of the color transfer process may, however, also be positioned on a separate substrate (image-receiving sheet), usually contains in a known manner a basic mordant for diffusible anionic (acid) dyes.

Long-chain quaternary ammonium or phosphonium compounds or tertiary sulfonium compounds, for example those compounds which are described in US-A Pat. No. 3,271,147 and US-A Pat. No. 3,271,148, are preferably used as mordants for acid dyes. Furthermore, certain metal salts and hydroxides thereof which form sparingly soluble compounds with the acid dyes may also be used. The dye mordants are dispersed in the receiving layer in a conventional hydrophilic binder, for example in gelatine, polyvinyl pyrrolidone, or completely or partially hydrolysed cellulose esters. Of course, some binders may also function as mordants, for example mixed polymers or polymer mixtures of vinyl alcohol and N-vinylpyrrolidone, as described, for example, in DE-B No. 1,130,284, also those which are polymers of nitrogen-containing quaternary bases, for example polymers of N-methyl-2-vinylpyridine, as described, for example, in US-A Pat. No. 2,484,430. Other mordanting binders which may be used include, for example, guanylhydrazone derivatives of alkyl vinylketone polymers, as described in US-A Pat. No. 2,882,156, or guanylhydrazone derivatives of acylstyrene polymers, as described, for example, in DE-A No. 2,009,498.

However, other binders, for example gelatine are generally also added to the last-mentioned mordanting binders. Other polymeric mordants are described, for example in US-A Pat. No. 3,709,690 and in DE-A No. 2,315,304; DE-A No. 2,445,782; DE-A No. 2,551,786 and DE-A No. 2,631,521.

Moreover, the color-photographic recording material according to the present invention may also contain acid layers and so-called retarding or delaying layers which together form a so-called integral neutralisation system. An integral neutralisation system of this type may be positioned in a known manner between the substrate and the image-receiving layer positioned thereon, or at another point in the laminated structure, for example above the photosensitive layers, i.e., on the other side of these photosensitive layers, seen from the image-receiving layer. The neutralisation system is usually oriented such that the retarding or delaying layer is positioned between the acid layer and the point at which an alkaline developing liquid or developing paste is applied. Such acid layers, retarding layers etc., from both existing neutralisation systems are known, for example, from US-A Pat. No. 2,355,030; US-A Pat. No. 2,983,606; US-A Pat. No. 3,362,819; US-A Pat. No. 3,362,821 and from DE-A No. 2,455,762; DE-A No. 2,601,653; DE-A No. 2,716,505 and DE-A No. 2,816,878. A neutralisation system of this type may also contain in a known manner two or more retarding layers.

Moreover, in a particular embodiment, the recording material according to the present invention may contain one or more pigmented, opaque layers which are permeable to aqueous liquids. These layers may fulfil two functions: On the one hand, the layers may prevent the undesired entry of light into photosensitive layers, and on the other hand, a pigment layer of this type, in particular if a light or white pigment, for example $TiO_2$, is used, may form an aesthetically pleasant background for the color image which is produced. Integral color-photographic recording materials having a pigment layer of this type are known, for example from US-A Pat. No. 2,543,181 and from DE-B No. 1,924,430. Instead of a preformed opaque layer, means may also be provided to produce such a layer only during the course of the development process. Corresponding to the two functions mentioned, pigment layers of this type may comprise two or more partial layers, one of which contains a white pigment, for example, and the other contains, for example, a dark, light-absorbing pigment, for example carbon black.

In a particularly prefrred embodiment of the present invention, the photographic material is an integral color-photographic recording material for carrying out the dye diffusion transfer process and it has, for example, the following layer elements:

(1) a transparent substrate,
(2) an image-receiving layer,
(3) a light-reflecting layer,
(4) a photosensitive element with at least one photosensitive silver halide emulsion layer and a combination associated with this layer of reducible dye-releaser and ED precursor compound,
(5) a retarding layer,
(6) an acid polymer layer, and
(7) a transparent substrate.

The monosheet material may be assembled such that two different parts are produced separately from each other, namely the photosensitive part (layer elements 1 to 4) and the cover sheet (layer elements 5 to 7) which are then positioned one on top of the other on the layer side and are joined together, optionally using spacing strips, so that a space is formed between the two parts for receiving an exactly measured quantity of a developer preparation. The layer elements 5 and 6 which together form the neutralisation system may also be positioned between the substrate and the image-receiving layer of the photosensitive part, but in the reverse order.

Furthermore, means may also be provided for introducing a developer preparation between the photosensitive part and the cover sheet, for example in the form of a rupturable container which is positioned on the side and discharges its contents between two adjacent layers of the monosheet material under the influence of mechanical force.

In addition to aqueous alkali, the developer preparation may also contain developer compounds which, however, must be co-ordinated with the type of dye-producing compounds. Other possible components of the developer preparation include thickening agents to increase the viscosity, for example hydroxyethyl cellulose, silver halide solvents, for example sodium thiosulphate, or one of the bis-sulfonyl alkane compounds described in DE-A No. 2,126,661, and opacifiers to produce opaque layers, for example pigments of $TiO_2$, ZnO, barium sulphate, barium stearate or kaolin. Some of these components may alternatively or additionally be embedded in one or more layers of the color-photographic recording material of the present invention.

EXAMPLE 1

A mordant layer, a light-reflecting layer and a photosensitive silver halide emulsion layer were applied in the following sequence to a transparent substrate of cellulose triacetate:

Mordant layer 3.75 g of a copolymer of 1 part of styrene and 1 part of maleic acid imide of N,N-dimethyl-N-hexadecyl-N--amino-propyl-ammonium bromide were dissolved in 15 ml of ethanol, and this solution was stirred into 75 ml of a 5% gelatine solution and homogenised. After adding 2.6 ml of a 5% saponin solution and 1 ml of a 2% aqueous mucochloric acid solution, the mixture was adjusted to a conventional casting viscosity (about 11 mPa.s), and the solution was applied to the substrate at 40° C. by the dip process (casting rate 5 m/min).

Light-reflecting layer

A suspension of 42 g of $TiO_2$ in 20 ml of water was dispersed in 150 ml of an 8% aqueous gelatine solution with the addition of 5 ml of a 5% aqueous solution of sodium dodecyl benzene sulfonate and 5 ml of 5% aqueous saponin solution. After adding 1 ml of a 2% mucochloric acid solution, the dispersion was adjusted to a viscosity of 13 mPa.s at 40° C., and was applied to the dried mordant layer by the dip process (casting rate 5 m/min).

Silver halide emulsion layer 1 mmol of one of the dye-releasers specified in the following and 1.5 mmol of one of the ED precursor compounds also specified in the following were dissolved in 5 ml of ethyl acetate and, after adding 2 ml of palmitic acid diethylamide, were emulsified in a Bühler homogeniser at about 1,000 r.p.m. into 25 ml of a 5% gelatine solution with the addition of 5 ml of a 5% aqueous solution of sodium-dodecylbenzene sulfonate. The emulsion was filtered over a folded filter, and made up to 75 ml with 5% gelatine solution.

After adding 1 ml of a 2% mucochloric acid solution, the emulsiom was mixed with 32 g of a ready-for-casting silver bromo-iodide emulsion. This emulsion was produced using 74 g of $AgNO_3$/kg of emulsion. It had an Ag/gelatine ratio of 1:1.1. The silver bromide emulsion contained 0.67 mol % of silver iodide.

The mixtures were applied to the previously described support by the dip process at a rate of 5 m/min at about 40° C.

After drying for 24 hours, the different samples were exposed on the emulsion side through grey step filter and were developed for 4 minutes at 18° C. using a developer paste which was applied in a thickness of about 300 μm and was composed as described in the following, were stopped for 2 minutes in a 5% acetic acid solution, and then briefly rinsed and dried.

Developer 20 g of carbethoxymethyl cellulose were dissolved with stirring in 800 ml of water.
40 g of solid NaOH,
1.5 g of ethylenediamine-tetra-acetic acid-sodium salt,
11.5 g of borax,
1 g of sodium hexametaphosphate,
3 g of KBr,
1.6 g of 1-phenyl-4-methyl-4-oxymethyl-pyrazolidone-3, and 0.1 g of 1-phenyl-5-mercaptotetrazole were added to the homogeneous solution.

The solution was made up to 1000 ml with water, and the pH was then adjusted to 13.2 to 13.3 by adding 30 ml of glacial acetic acid.

The following dye-releasers A, B and C were used for the following experiments.

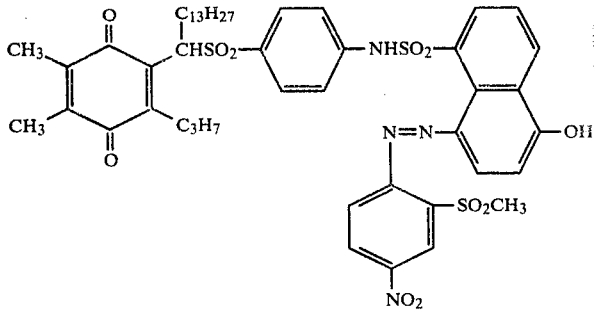

A

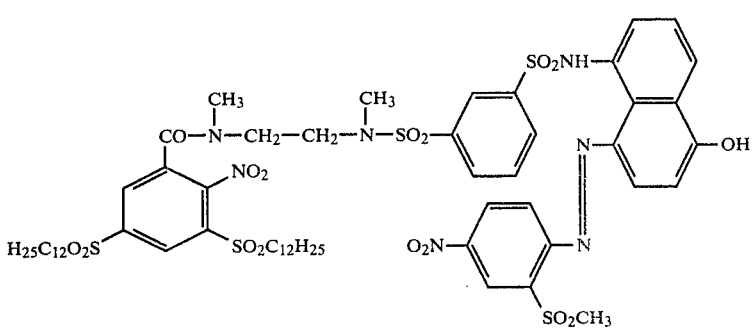

B

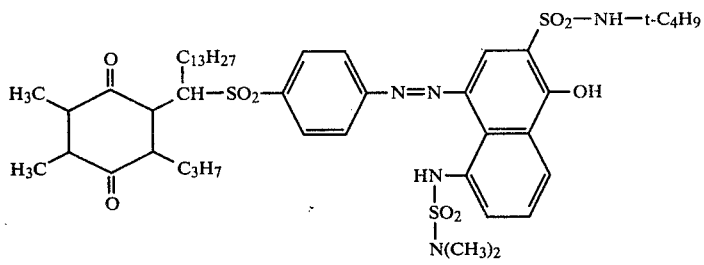

C

A compound corresponding to the following formula was used as a known ED precursor compound for comparison (EP-A No. 0,034,749, compound 4):

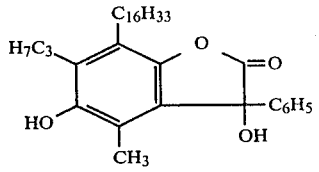

D

The following combinations were tested for the $D_{min}/D_{max}$ values which may be achieved:

| Dye | ED compound | $D_{min}$ | $D_{max}$ |
|---|---|---|---|
| A | D | 0.46 | 1.92 |
| | 8 | 0.16 | 1.82 |
| | 14 | 0.02 | 1.56 |
| | 15 | 0.02 | 1.80 |
| | 18 | 0.02 | 0.98 |
| B | D | 0.16 | 1.86 |

-continued

| Dye | ED compound | $D_{min}$ | $D_{max}$ |
|---|---|---|---|
| | 8 | 0.06 | 1.76 |
| | 15 | 0.03 | 1.56 |
| C | D | 0.18 | 1.93 |
| | 8 | 0.11 | 1.90 |
| | 15 | 0.06 | 1.93 |

EXAMPLE 2

(not according to the present invention)

A photosensitive element of a photographic recording material was produced by successively applying the following layers to a transparent substrate consisting of polyethylene terephthalate. The quantities relate in each case to one square meter.

1. Green-sensitized AgBr-negative emulsion layer consisting of 0.55 g of $AgNO_3$, containing 0.17 g of dye-releaser C (compound releasing magenta dye), 0.12 g of ED precursor compound E (compound according to Research Disclosure 19507, July 1980), 0.29 g of diethyllauramide and 1 g of gelatine.
2. Protective layer containing 0.05 g of 2-isooctadecyl-5-sulfohydroquinone, 0.74 g of acetylation product of 4-methylphenidone, 0.47 g of palmitic acid diethylamide and 2 g of gelatine.

3. Opaque light-reflecting layer containing 13.45 g of $TiO_2$ and 2 g of gelatine.
4. Protective layer containing 3.85 g of gelatine and 0.20 g of diisooctyl hydroquinone.
5. Image-receiving layer containing 2.5 g of a polymeric mordant of 4,4'-diphenylmethane-diisocyanate and N-ethyldiethanolamine, quaternised with epichlorohydrin according to DE-A No. 2,631,521, Example 1, and 6.25 g of gelatine.
6. Protective and hardening layer containing 0.9 g of compound F (hardening agent) and 0.6 g of gelatine.

The recording material was exposed through the transparent substrate behind a conventional grey wedge and was developed in an open tray at 22° C. for 15 minutes in a bath having the following composition:

921 g of $H_2O$
25 g of 2-methyl-2-propyl-1,3-propanediol,
20 g of 1,4-cyclohexanedimethanol 50%,
3 g of KBr, and
40 g of KOH.

The material was then rinsed for 5 minutes and was dried.

EXAMPLES 3 AND 4

(according to the present invention)

The process was carried out as stated in Example 2, but instead of the photosensitive element described in Example 2, such elements were used which contained the ED precursor compounds Nos. 8 and 26 according to the present invention, instead of ED precursor compound E in layer 1, in the same molar quantity.

The recording materials obtained according to Examples 2, 3 and 4 produced positive magenta transfer images having the following $D_{min}/D_{max}$ values:

| ED compound | $D_{min}$ | $D_{max}$ |
|---|---|---|
| E | 0.10 | 0.68 |
| 8 | 0.12 | 1.57 |
| 26 | 0.13 | 1.50 |

EXAMPLE 5

The kinetics of the dye formation were investigated for ED precursor compound E (comparison) and for ED precursor compounds Nos. 8 and 26 according to the present invention by measuring, for each of the materials to be tested, the color density produced in the image-receiving layer depending on the development time and by representing the values as a curve. FIG. 1 represents the color density (ordinate) as a function of the development time (abscissa) for ED precursor compound 1 (curve 1), and for ED precursor compound 8 (curve 2) and for ED precursor compound 26 (curve 3) of the present invention. It may be seen that the compounds according to the present invention are clearly more active, i.e., they produce clearly higher color transfers, particularly with shorter development times.

EXAMPLE 6

A photosensitive element of a photographic recording material according to the present invention was produced by successively applying the following layers to a transparent substrate consisting of polyethylene terephthalate. The quantities relate in each case to one square meter.

1. Blue-sensitized AgBr-negative emulsion layer consisting of 0.76 g of $AgNO_3$, containing 0.29 g of dye-releaser G (compound releasing yellow dye), 0.23 g of ED precursor compound No. 8 0.52 g of palmitic acid diethylamide and 1.5 g of gelatine.
2. Yellow filter layer containing 0.16 g of yellow dye Solvent Yellow 29 (C.I. 21230), 0.05 g of 2-isooctadecyl-5-sulfo-hydroquinone and 1.0 g of gelatine.
3. Green-sensitized AgBr negative emulsion layer consisting of 0.55 g of $AgNO_3$, containing 0.17 g of dye resistor C (compound releasing magenta dye), 0.11 g of ED precursor compound No. 8, 0.28 g of diethyllauramide and 1 g of gelatine.
4. Intermediate layer containing 0.07 g of 2-isooctadecyl-5-sulfo-hydroquinone, 0.47 g of acetylation product of 4-methyl-1-phenylpyrazolidone-(3) (developer) and 2 g of gelatine.
5. Red-sensitized AgBr-negative emulsion layer consisting of 0.5 g of $AgNO_3$, containing 0.20 g of dye releaser H (compound releasing cyan dye), 0.10 g of ED precursor compound No. 8, 0.30 g of palmitic acid diethylamide and 1.14 g of gelatine.
6. Protective layer containing 0.05 g of acetylation product of 4-methyl-1-phenylpyrazolidone-(3) and 0.63 g of gelatine.
7. Opaque light-reflecting layer containing 13.45 g of $TiO_2$ and 20 g of gelatine.
8. Protective layer containing 3.85 g of gelatine and 0.2 g of diisoctylhydroquinone.
9. Image-receiving layer containing 2.53 g of a polymeric mordant consisting of 4,4'-diphenylmethane diisocyanate and N-ethyldiethanolamine, quaternised with epichlorohydrin according to DE-A No. 2,631,521, Example 1, and 6.34 g of gelatine.
10. Protective and hardening layer containing 0.9 g of compound F (hardening agent) and 0.6 g of gelatine.

The recording material thus produced was exposed and developed as in Example 2. After rinsing and drying, the positive multicolored transfer image produced the following $D_{min}$ and $D_{max}$ values:

| | B | G | R |
|---|---|---|---|
| $D_{min}$ | 0.19 | 0.19 | 0.18 |
| $D_{max}$ | 1.95 | 1.88 | 2.15 |

EXAMPLE 7

The process was carried out as stated in Example 6, but 0.31 g of dye releaser J were used instead of dye-releaser G in layer 1, and 0.25 g of dye-releaser K were used instead of dye-releaser C in layer 3. The recording material thus produced was exposed and developed as in Example 2.

The positive multicolored transfer image produced the following $D_{min}$ and $D_{max}$ values:

| | B | G | R |
|---|---|---|---|
| $D_{min}$ | 0.20 | 0.19 | 0.18 |
| $D_{max}$ | 2.20 | 2.02 | 2.08 |

Figure 2:
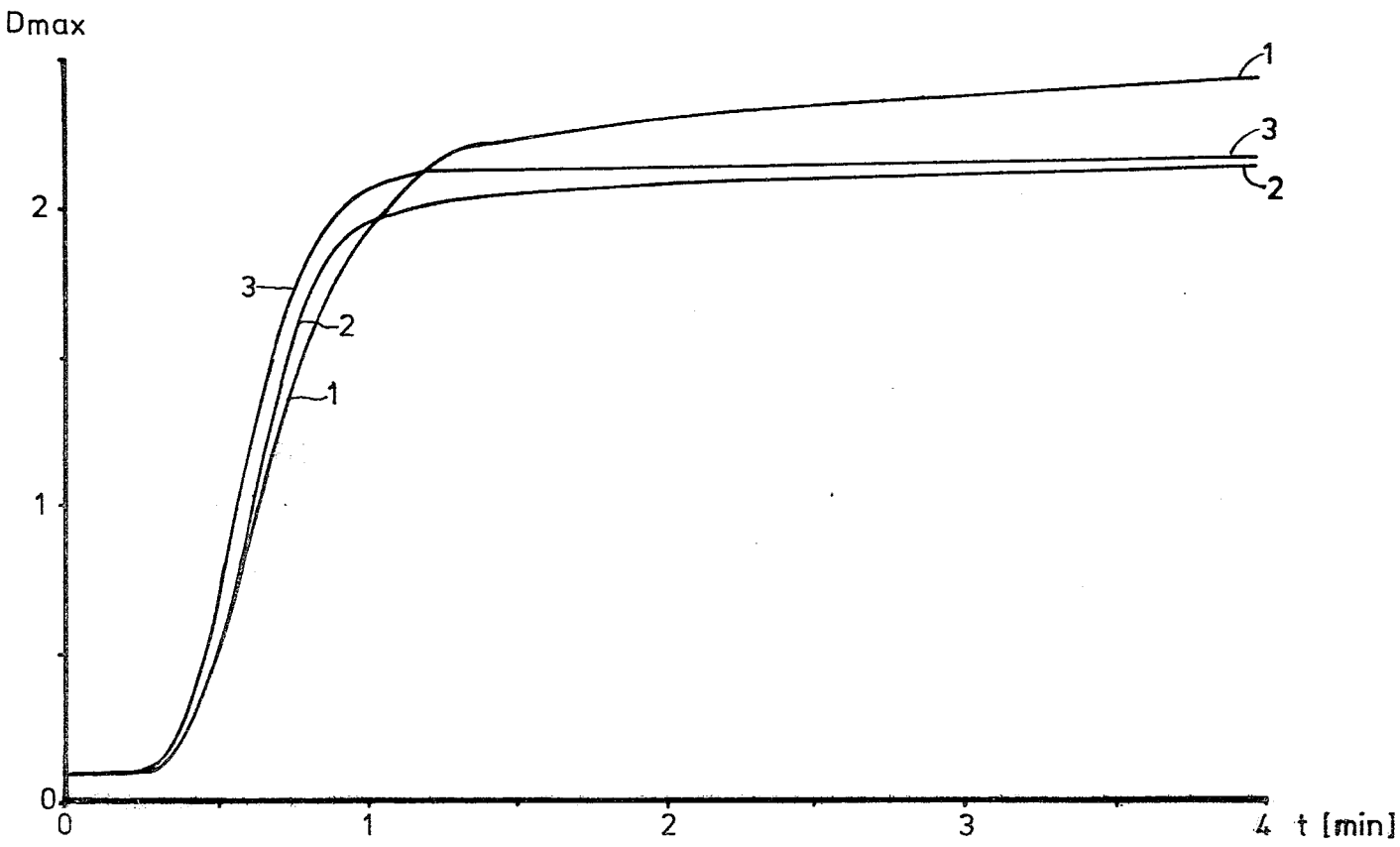

In FIG. 2, the color density produced in the image-receiving layer depending on the development time is measured and represented as a curve (curve 1-blue filter; curve 2-green filter; curve 3-red filter). The image formation rate of all three colors is almost the same and development is almost completed after about one minute.

Formulae relating to Example 2 to 7

E

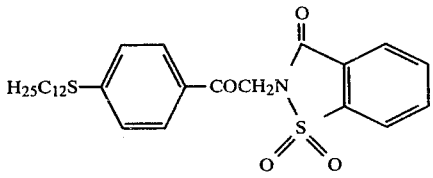

F

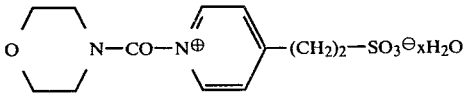

G

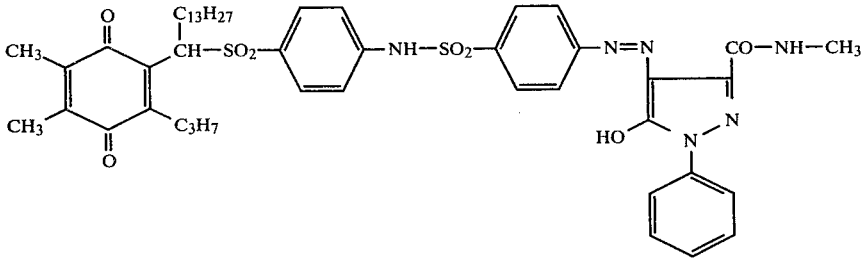

H

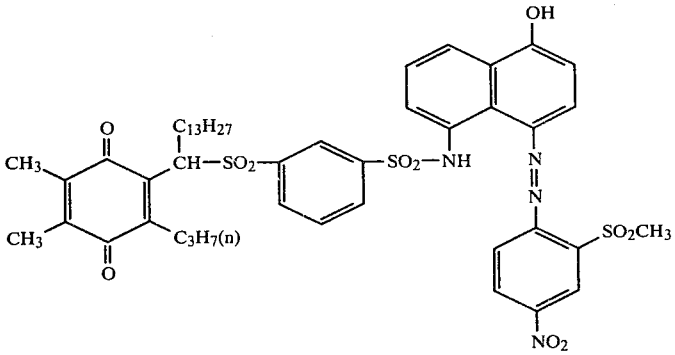

J

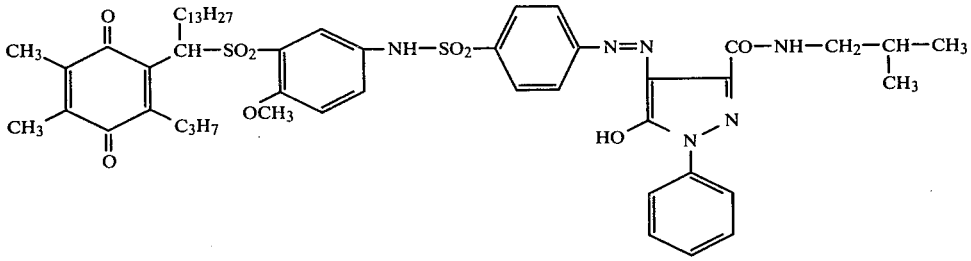

K

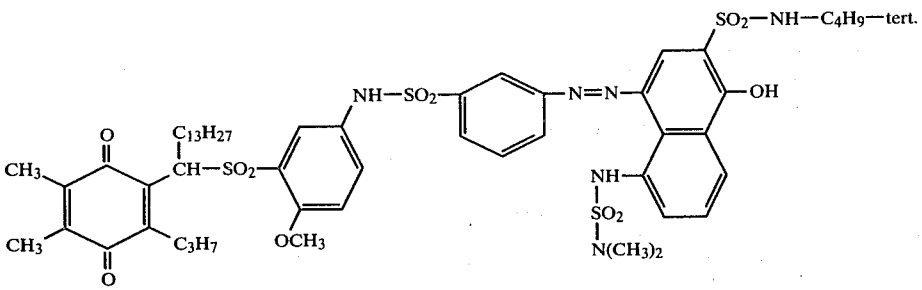

We claim:

1. A color-photographic recording material comprising at least one photosensitive silver halide emulsion layer and a non-diffusing color-providing compound associated with this layer, which material contains, in at least one photosensitive silver halide emulsion layer or in a non-photosensitive binder layer, a non-diffusing electron donor precursor compound (ED precursor compound), from which a non-diffusing ED compound is formed under alkaline development conditions, wherein the improvement comprises the ED precursor compound corresponds to the following formula I:

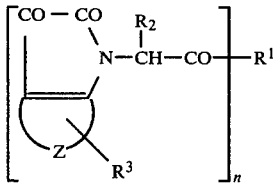

I wherein

Z represents a radical which completes a condensed aromatic ring system;

$R^1$ represents an n-valent aliphatic or aromatic radical;

$R^2$ represents H, alkyl or aryl, $R^3$ represents one or more radicals to control the diffusion properties and the activation pH;

and n represents 1 or 2.

2. A color-photographic recording material comprising at least one photosensitive silver halide emulsion layer and a combination associated with this layer of a non-diffusing, reducible color-providing compound which, in reduced condition, is capable of releasing a diffusible dye under alkaline development conditions, and a non-diffusing electron donor precursor compound (ED precursor compound), from which a non-diffusing electron donor compound (ED compound) is formed under alkaline development conditions, which ED compound is capable of reducing the non-diffusing, color-providing compound under alkaline development conditions, wherein the improvement comprises the recording material contains as the ED precursor compound a compound corresponding to the following formula I:

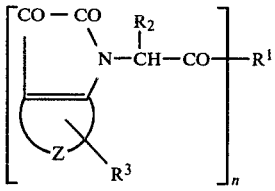

I wherein

Z represents a radical which completes a condensed aromatic ring system;

$R^1$ represents an n-valent aliphatic or aromatic radical;

$R^2$ represents H, alkyl or aryl, $R^3$ represents one or more radicals to control the diffusion properties and the activation pH;

and n represents 1 or 2.

3. A recording material as claimed in claim 2, wherein a compound corresponding to the following formula II is used as the non-diffusing, reducible color-providing compound:

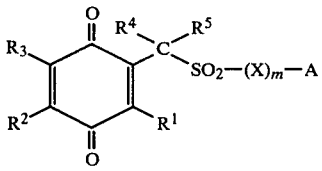

II wherein $R^1$ represents alkyl or aryl, $R^2$ represents alkyl, aryl or a group which, together with $R^3$, completes a condensed ring, $R^3$ represents hydrogen, alkyl, aryl, hydroxyl, halogen, amino, alkylamino, dialkylamino including cyclic amino groups, acylamino, alkylthio, alkoxy, aroxy, sulfo, or a group which, together with $R^2$, completes a condensed ring, $R^4$ represents alkyl, $R^5$ represents hydrogen, A represents the radical of a diffusible dye or dye precursor, X represents a divalent connecting member, and m represents 0 or 1.

* * * * *